United States Patent [19]

Huang

[11] Patent Number: 4,487,332

[45] Date of Patent: Dec. 11, 1984

[54] CRYOSTAT VESSEL WALL SPACING SYSTEM

[75] Inventor: Yuchi Huang, Madison, Wis.

[73] Assignee: Nicolet Instrument Corporation, Madison, Wis.

[21] Appl. No.: 576,521

[22] Filed: Feb. 2, 1984

[51] Int. Cl.[3] ..... B65D 7/22

[52] U.S. Cl. ..... 220/445; 220/1 B; 220/901

[58] Field of Search ..... 220/445, 1 B, 3, 425, 220/446, 901

[56] References Cited

U.S. PATENT DOCUMENTS

| | | | |
|---|---|---|---|
| 1,598,149 | 8/1926 | Mott . | |
| 2,911,125 | 11/1959 | Dosker . | |
| 2,954,003 | 9/1960 | Farrell et al. . | |
| 3,007,598 | 11/1961 | Beam . | |
| 3,054,524 | 9/1962 | Casten | 220/445 |
| 3,092,933 | 6/1963 | Closner et al. . | |
| 3,201,108 | 8/1965 | Kramer | 220/445 X |
| 3,312,076 | 4/1967 | Clarke et al. . | |
| 3,839,981 | 10/1974 | Gilles . | |
| 4,038,832 | 8/1977 | Lutgen et al. . | |
| 4,136,493 | 1/1979 | Bradford et al. . | |
| 4,212,169 | 7/1980 | Kneip, Jr. . | |
| 4,376,489 | 3/1983 | Clemens . | |

*Primary Examiner*—Steven M. Pollard

*Attorney, Agent, or Firm*—Kinney & Lange

[57] ABSTRACT

In a cryostat of the type having nested vessels, a cryostat vessel wall spacing system wherein a plurality of rigid spacer stubs are secured between the vessel walls of adjacent vessels. The spacer stubs are mounted on the wall of an inner vessel to extend axially outwardly. A plurality of stub caps are secured to the adjacent vessel wall of a next outer vessel, with each stub cap having a recess designed to retain one of the spacer stubs therein. Each spacer stub engages its respective stub cap and is retained within the recess thereof when the walls of the nested vessels are at substantially the same temperature to uniformly and rigidly space apart the vessel walls of the nested vessels. When the vessel walls thermally contract because of the introduction of low temperature liquified gas into the inner vessel, each of the spacer stubs is withdrawn from its respective recess a distance sufficient to disengage said spacer stub and stub cap. In a preferred embodiment, a plurality of spacer stubs and stub caps are secured in coaxial alignment between a plurality of nested cryostat vessels when the vessels are at substantially the same temperature.

13 Claims, 7 Drawing Figures

CRYOSTAT VESSEL WALL SPACING SYSTEM

BACKGROUND OF THE INVENTION

1. Field of the Invention

This invention relates to systems for spacing surfaces of potentially varying temperature, and specifically for rigidly spacing the walls of nested vessels in a cryostat when the vessels are at substantially the same temperature and eliminating heat conduction paths between such vessels through the spacing system when low temperature liquified gases are retained in the cryostat.

2. Description of the Prior Art

Cryostats are often used for the containment of superconducting apparatus such as superconducting magnets. A magnet coil is maintained at very low temperature by an envelope of liquid helium. The liquid helium is further surrounded by various insulating envelopes from the ambient temperature, including typically a surrounding layer of liquid nitrogen.

Cryostats have typically taken the form of nested vessels which are internally braced to maintain minimum clearances between adjacent nested vessel walls. It is often desireable to assemble a cryostat prior to shipment to its ultimate working location. Thus, the internal bracing must be rigid enough to withstand the mechanical loads (in all directions) which can occur during the shipping process. This has resulted in rather complicated spacing and bracing schemes. Stainless steel spokes have been used in order to withstand mechanical shock between walls. Such spokes, however, provide heat conduction paths between the walls of the vessels, which are to be maintained at different temperatures when the cryostat is in use in order to create the various thermal insulation envelopes.

One attempt to eliminate such heat conduction is shown in U.S. Pat. No. 4,212,169, granted to Kneip, Jr. on July 15, 1980 and which is hereby incorporated by reference. The vessels of the Kneip, Jr. cryostat are spaced apart by a plurality of polyester cord fasteners. While the use of this material does reduce heat conduction, there is still a direct material path between adjacent vessel walls through such cord fasteners when low temperature liquified gases are retained in the cryostat.

Other attempts to thermally insulate liquified gas containers are shown in U.S. Pat. No. 4,038,832, granted to Lutgen et al. on Aug. 2, 1977 and U.S. Pat. No. 3,839,981, granted to Gilles on Oct. 8, 1974 which are hereby incorporated by reference. These patents show studs extending from outer walls of an inner vessel to be retained within a bracket mounted on a next vessel or framework. When liquified gas is introduced into the inner vessel, contraction of the studs with respect to the brackets occurs, but there is still contact between the studs and brackets and thus the heat conduction path between the inner and outer vessels is never completely broken. U.S. Pat. No. 2,911,125, granted to Dosker on Nov. 3, 1959 and incorporated by reference herein, shows a storage tank for cold liquids which is supported with respect to an outer frame during contraction by a plurality of annular rings received within grooves in the tank. Upon the introduction of cold liquids into the tank, the tank contracts, but the rings are never withdrawn from the grooves, thereby continually providing heat conduction paths between the framework and the tank. U.S. Pat. No. 3,007,598, granted to Beam on Nov. 7, 1961 and U.S. Pat. No. 2,954,003, granted to Farrell et al. on Sept. 27, 1960 which are hereby incorporated by reference, both show means for transportation of low temperature liquids in tanks. The tanks are supported with protrusions therefrom fitted in recesses in a next outer tank. The patents show and discuss these protrusion and recess arrangements for nested containers and the relative movements thereof, but there is no anticipation of the complete elimination of contact between the innerlocking parts of the containers of these patents.

Prior art spacing systems for nested temperature vessels such as those discussed above have been unsuitable in practice for a variety of reasons. When the spacing system comprises rigid members such as stainless steel spokes, the spokes permit heat transfer between temperature vessels. The use of polyester cords reduces, but does not eliminate such heat conduction and provide no rigidity between vessels during transport of the cryostat. The other systems shown and discussed above also do not eliminate direct heat conduction paths between adjacent nested vessel walls when low temperature liquified gases are stored therein.

SUMMARY OF THE INVENTION

The present invention provides a cryostat vessel wall spacing system which rigidly spaces nested vessel walls when they are at substantially the same temperature and eliminates heat conduction paths between adjacent vessel walls when low temperature liquified gases are introduced therein. The spacing is attained by a plurality of rigid spacer stubs secured to a vessel wall at a first vessel of a cryostat and extending axially toward an adjacent vessel wall of a second vessel of the cryostat. A plurality of stub caps are secured to the adjacent vessel wall of the second nested vessel, with each stub cap having a recess designed to retain one of the spacer stubs therein. Each spacer stub engages its respective stub cap and is retained within the recess thereof when the walls of the nested vessels are at substantially the same temperature to uniformly and rigidly space apart the vessel walls of the nested vessels. When low temperature liquified gas is introduced into an inner one of the nested vessels, each spacer stub is withdrawn from its respective recess a distance suficient to disengage said spacer stub and spacer cap when the vessel walls thermally contract.

In a preferred embodiment, there are at least three nested vessels with spacer stubs and spacer caps between adjacent walls thereof. These spacer stubs and caps are axially aligned along a common spacing axis when the vessels are at substantially the same temperature. The spacer stubs and stub caps are made of a material having high mechanical strength and low thermal conductivity characteristics. Epoxy impregnated fiberglass is an example of such material. In addition, the lateral cross-sectional area of an outer end of each spacer stub is reduced with respect to the lateral cross-sectional area of other portions of said spacer stub to further reduce potential contact area and thus the potential thermal conduction path between said spacer stub and its respective stub cap.

DETAILED DESCRIPTION OF THE PREFERRED EMBODIMENTS

Figure 1:
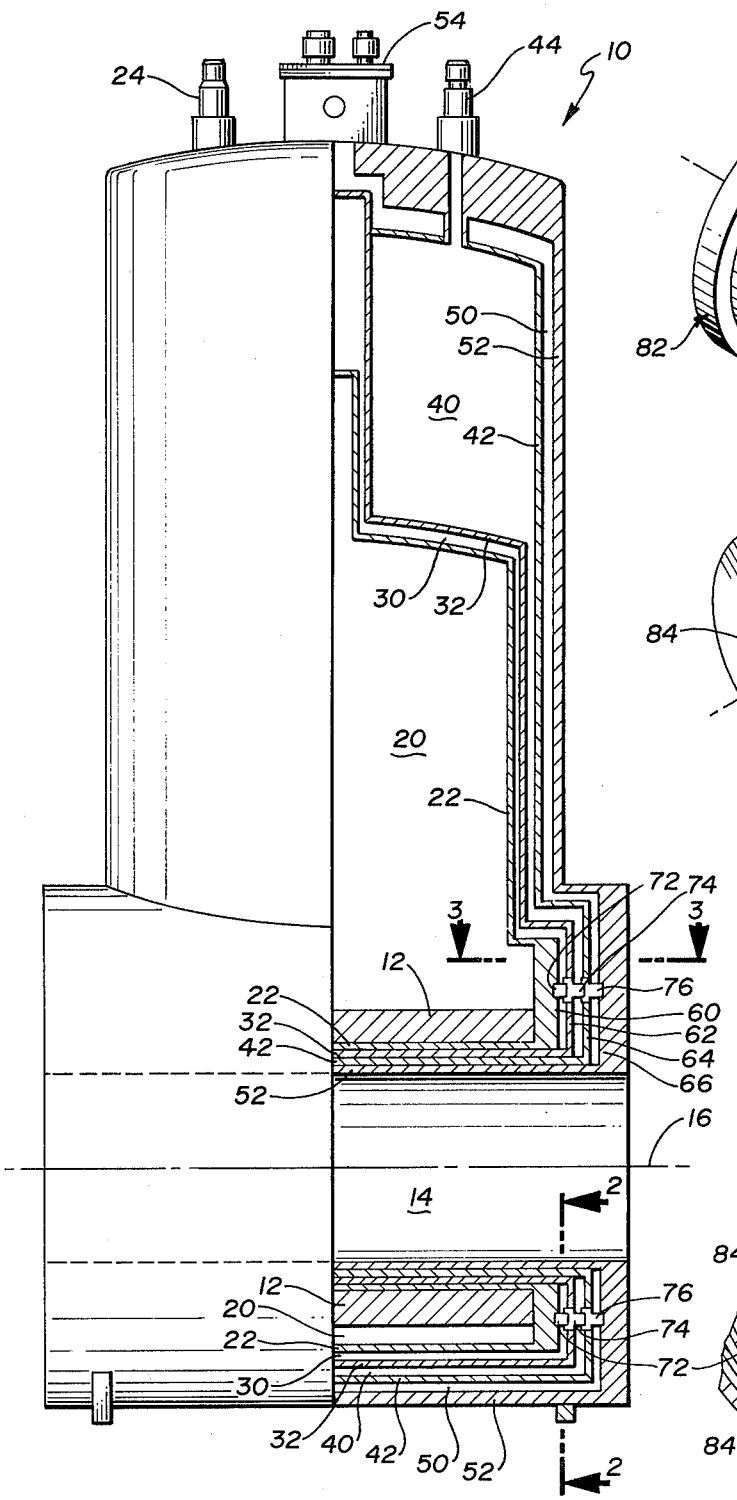
FIG. 1 is a side elevational view of a cryostat in half-section having the vessel wall spacing system of the present invention mounted therein.

In FIG. 1, a cryostat 10 is shown in a configuration suitable for use with an NMR spectrometer. The cryostat 10 surrounds a solenoid assembly 12 which creates a desired magnetic field within a test specimen reception bore 14. The bore 14, which extends through the solenoid assembly 12, communicates at each end with the atmosphere surrounding the cryostat 10. As shown, the bore 14 and solenoid assembly 12 are positioned generally concentrically about an axis 16.

The solenoid assembly 12 is housed within a first vessel 20 within the cryostat 10. The first vessel 20 is defined by a first vessel wall 22. Typically, liquid helium (at approximately −268.8° C.) is introduced into the first vessel 20 when the cryostat 10 is to be used for testing the composition of a specimen placed within its bore 14. The liquid helium cools the solenoid assembly 12, increasing its conductivity and thereby enhancing its ability to create a magnetic field within the bore 14. The liquid helium is introduced into the first vessel 20 via suitable input means, such as a connector 54 mounted on the outside of the cryostat 10 which communicates with the interior of the first vessel 20.

A second vessel 30 is defined by a second vessel wall 32 and surrounds the first vessel 20 as shown. The second vessel 20 is typically exhausted to attain a vacuum-like atmosphere therein to provide an insulation layer between the first and second vessel walls 22 and 32.

A third vessel 40 defined by a third vessel wall 42 similarly surrounds the second vessel 30. The third vessel 40 is typically filled with liquid nitrogen (at approximately −196.2° C.) which acts as a further insulation layer about the first and second vessels 20 and 30. The liquid nitrogen is introduced into the third vessel 40 via suitable input means, such as a connector 44 mounted on the outside of the cryostat 10 which communicates with the interior of the third vessel 40. When liquid helium and nitrogen have been thus introduced into the first and third vessels 20 and 40, the temperature in the second exhaust vessel 30 is approximately −251° C.

A fourth vessel 50 defined by a fourth vessel wall 52 surrounds the third vessel 40 as shown. The fourth vessel 50 is also exhausted to attain a vacuum-like atmosphere therein to provide an insulation layer between the third and fourth vessel walls 42 and 52. Some portions of the fourth vessel wall 52 also define the exterior or outer wall surface of the cryostat 10. The temperature outside of the cryostat 10 (and fourth vessel wall 52) is typically approximately 26.8° C., so the fourth exhausted vessel 50 attains an intermediate temperature to buffer the liquid nitrogen in the third vessel 40 from the outer temperature. The second and fourth vessels 30 and 50 are exhausted by suitable means (not shown) connected to communicate with said vessels through an exhaust port assembly 54 mounted on the outside of the cryostat 10.

Figure 2:
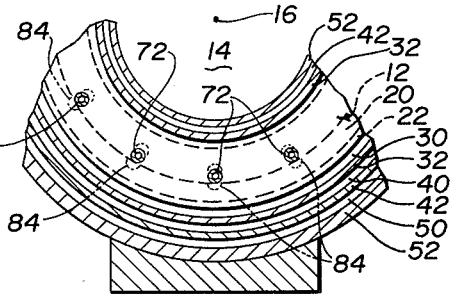
FIG. 2 is a partial sectional view as taken along line 2—2 in FIG. 1.

Proximate the solenoid assembly 12, each of the vessels has a cylindrically shaped portion generally concentrically positioned about the axis 16. As best seen in a comparison of FIGS. 1 and 2, the cylindrical portions of the vessels are nested with the first vessel 20 being innermost and the fourth vessel 50 being outermost. This nested vessel arrangement for the cryostat 10 thus provides means to effectively maintain the temperature of the liquid helium within the first vessel 20 at a temperature approximately 296° C. lower than the ambient temperature about the cryostat 10. As best shown in FIG. 2, the first, second, third and fourth vessel walls (22, 32, 42 and 52) are generally concentrically mounted about the axis 16 in the cylindrical portions of the respective vessels.

At each end of its cylindrically shaped portion, a portion of each vessel wall is generally ring-shaped and aligned generally perpendicularly to the axis 16. The first vessel wall 22 has a first ring-shaped end wall 60, the second vessel wall 32 has a second ring-shaped end wall 62, the third vessel wall 42 has a third ring-shaped end wall 64 and the fourth vessel wall 52 has a fourth ring-shaped end wall 66.

Figure 3:
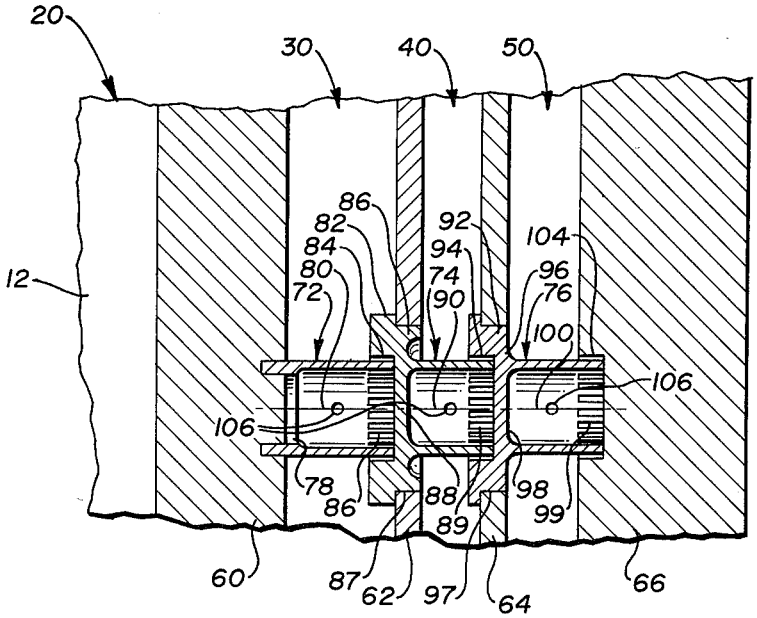
FIG. 3 is an enlarged partial sectional view taken along line 3—3 in FIG. 1 showing the relative positions of the components of the spacer system when the vessel walls are at substantially the same temperature.

The vessel walls of the cryostat 10 are relatively rigid. To prevent shifting or breaking thereof during shipment of the cryostat 10, and to maintain a uniform spacing between the various vessel walls to attain the desired insulation envelopes about the first vessel 20, a spacing system is provided between adjacent vessel walls. Specifically, the spacing system is located between adjacent end walls of the respective vessels. As shown in FIGS. 1 and 3 (which illustrates the relative positions of the cryostat vessel walls when the vessels are at substantially the same temperature), a first spacer stub 72 extends between the first end wall 60 and second end wall 62. A second spacer stub 74 extends between the second end wall 62 and a third end wall 64. A third spacer stub 76 extend between the third end wall 64 and fourth end wall 66. A plurality of such spacer stubs are mounted between each of the adjacent end walls generally as shown in FIG. 2. The spacer stubs thus provide means to rigidly and uniformly space adjacent vessel walls to internally brace the nested vessels of the cryostat in a manner sufficient to take mechanical loads in all directions which can occur during shipment and installation.

As best shown in FIG. 3, the first spacer stub 72 has an inner end 78 and outer end 79 which define a stub spacing axis 80. The inner end 78 of the first stub 72 is affixed to or embedded in the first end wall 60 so that the stub spacing axis 80 extends outwardly generally perpendicularly with respect to the first end wall 60.

A plurality of first stub caps 82 are secured to the second end wall 62. Each first stub cap 82 has a recess 84 defined therein which is axially aligned for reception of the outer end 79 of the first spacer stub 72. As shown in FIG. 3, the first stub cap 82 and second spacer stub 74 are preferably formed as a unitary spacer component 86 which is secured in an aperture 87 in the second end wall 62 so that the recess 84 is on an inner side of the second end wall 62 and the second spacer stub 74 extends outwardly from an outer side of the second end wall 62. The second spacer stub 74 also has an inner end 88 and an outer end 89 to define a stub spacing axis 90. As shown, the inner end 88 of the second spacer stub 74 is mounted to the second end wall 62 so that the stub spacing axis 90 extends generally perpendicularly with respect to the second end wall 62.

A plurality of second stub caps 92 are secured to the third end wall 64. Each second stub cap 92 has a recess 94 defined therein which is axially aligned for reception of the outer end 89 of the second spacer stub 74. As shown in FIG. 3, the second stub cap 92 and third spacer stub 76 are preferably formed as a unitary spacer component 96 which is mounted in an aperture 97 in the third end wall 64. The recess 94 of the second stub cap 92 is thus positioned on an inner side of the third end wall 64 and the third spacer stub 76 extends outwardly from an outer side of the third end wall 64. The third spacer stub 76 also has an inner end 98 and an outer end 99 to define a stub spacing axis 100. As shown, the inner end 98 of the third spacer stub 76 is mounted to the third end wall 64 so that the stub spacing axis 100 extends generally perpendicularly with respect to the third end wall 64.

A plurality of recesses 104 are defined on an inner side of the fourth end wall 66. Each recess 104 is axially aligned for reception of the outer end 99 of the third spacer stub 76. As shown in FIG. 3, the recess 104 can be a recess within the fourth end wall 66 itself, or it can be defined in an additional stub cap component (not shown) which is secured to the inner side of the fourth end wall 66.

As shown in FIG. 3, the spacer stubs 72, 74 and 76 are coaxially aligned when the cryostat vessels are at substantially the same temperature. In this situation, the recesses 84, 94 and 104 are coaxial with the spacer axes as well. The components of the spacing system are thus aligned to rigidly absorb and transmit mechanical loads on the cryostat.

Figure 4:
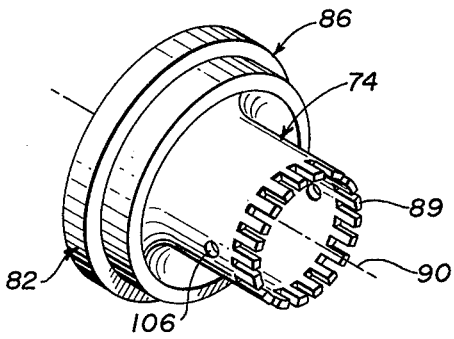
FIG. 4 is a pictorial view of one embodiment of the spacer stub of the cryostat vessel wall spacing system of the present invention.
Figure 5:
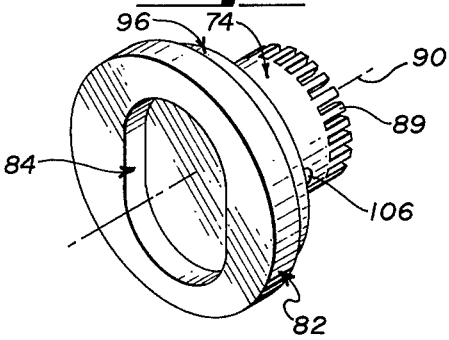
FIG. 5 is a pictorial view of the spacer stub of FIG. 4 rotated 90° about an axis perpendicular to its spacing axis.
Figure 6:
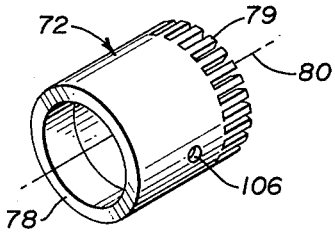
FIG. 6 is a pictorial view of another embodiment of the spacer stub of the present invention.

The preferred design for the spacer stub and stub cap components of the cryostat vessel wall spacing system of the present invention are more fully shown in FIGS. 4–6. FIGS. 4 and 5 illustrate the unitary spacer component 86 (which is essentially identical to the unitary spacer component 96). FIG. 6 shows a preferred design for the first spacer stub 72.

A sleeve portion (spacer stub 74) of the spacer component 86 is preferably generally cylindrically shaped to extend concentrically along the respective stub spacing axis (shown as axis 90). As shown in FIG. 6, the first spacer stub 72 is a sleeve which is similarly cylindrically shaped to extend concentrically along the respective stub spacing axis (shown as axis 80). The spacer components are preferably made of impregnated fiberglass rod having relatively high mechanical strength. The crylindrical sleeve shape for the spacer stubs is also conducive to high mechanical strength along their respective stub spacing axes. Each of the spacer stubs is also provided with a plurality of apertures 106 in its cylindrical walls. The apertures 106 provide drain holes to facilitate gas flow between adjacent vessel walls and within the vessel into which each respective spacer stub extends.

Figure 7:
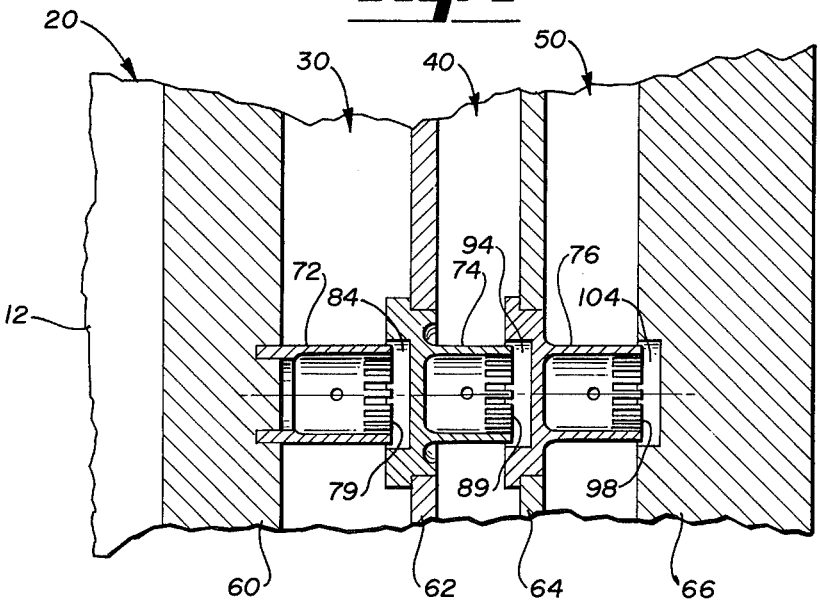
FIG. 7 is an enlarged partial sectional view similar to FIG. 3 and showing the relative positions of the components of the spacer system when low temperature liquified gas in introduced into the cryostat.

The introduction of the low temperature liquified gases such as helium and nitrogen into the cryostat vessels causes thermal contraction of the vessel walls because of their reduction in temperature. Adjacent vessel walls do not contract at the same rate, because they are subjected to different temperature changes as they are cooled. The inner vessel walls are cooled to a greater extent than the outer vessel walls and thus will contract more. As the vessel walls contract, the spacer stubs are withdrawn from their respective recesses a distance sufficient to disengage each spacer stub and its stub cap. Each spacer stub and stub cap combination completely separates so there is no direct heat conduction path between adjacent vessel walls when low temperature liquified gases are retained in the vessels of the cryostat 10. The relative position of the various spacing components in this situation is shown in FIG. 7. The outer end of each spacer stub is withdrawn from its respective recess. As shown, the recesses are large enough so that stubs do not touch the sides of the recesses when withdrawn therefrom.

In addition to providing high mechanical strength, the cylindrical sleeve shape of the spacer stubs also minimizes the cross-sectional area of the stub itself. Thus, if there is any invertent contact between the spacer stub and its respective stub cap which the cryostat 10 is in use (from misalignment of the spacer components or vessels, or from damage to the cryostat), the heat conduction path between the adjacent vessel walls created by such contact is minimized. To further minimize the possibility of heat conduction, the outer end of each spacer stub (such as outer ends 89 and 79 in FIGS. 4 and 6, respectively) are notched to reduce the cross-sectional area of these outer ends. The preferable material for the spacer components of the present invention, epoxy impregnated fiberglass, also has the characteristic of low thermal conductivity.

As viewed in FIG. 7, the stub spacer axes still appear coaxially aligned despite the thermal contraction of the vessel walls of the cryostat 10. This is not the case, however. FIG. 7 is a view of the spacer system components looking toward the axis 16. When the components are viewed as shown in FIG. 1 with respect to the axis 16 and thermal contraction takes place, the inner spacer components are moved closer to the axis 16 than the outer spacer components. This is because the inner vessel walls are subjected to colder temperatures than the other vessel walls and thus contract at a greater rate. To accommodate this relative movement between the spacer components, the recesses 84, 94 and 104 are elongated in direction radially perpendicular to the axis 16, which constitutes a thermal contraction axis. This elongation is shown with respect to the recess 84 in FIG. 5 and is illustrated in phantom with respect to the relative position of the recesses 84 in FIG. 2.

Elongation of each of the recesses in this manner permits the respective spacer stub received therein to move when the end wall upon which that spacer stub is mounted contracts thermally relative to the adjacent end wall upon which the respective stub cap is mounted. Because the recesses are so shaped, this relative movement of spacer components (along a line radially perpendicular to the axis 16) does not cause binding between the spacer stub and its stub cap and the respective components do not touch. The cryostat vessel wall spacing system of the present invention thus uniformly and rigidly spaces the vessel walls of the nested vessels of the cryostat during shipment and installation, yet eliminates heat conduction paths between adjacent vessel walls when low temperature liquified gases are introduced into the cryostat.

Although the present invention has been described with reference to preferred embodiments, workers skilled in the art will recognize that changes may be made in form and detail without departing from the spirit and scope of the invention.

What is claimed is:

1. A system for spacing the walls of nested vessels in a cryostat for containing low temperature liquified gases, the system comprising:

a first vessel defined by a first vessel wall;

a plurality of first spacer stubs, each first stub having inner and outer ends defining a first stub spacing axis, and the inner end of each first stub being secured to the first vessel wall so that the first stub extends outwardly therefrom with its axis generally perpendicular to adjacent portions of the first vessel wall;

a second vessel defined by a second vessel wall and designed to surround the first vessel;

a plurality of first stub caps, each first stub cap having a recess therein and being secured to the second vessel wall with said recess axially aligned for reception of the outer end of one of the first stubs when the first and second vessel walls are at substantially the same temperature;

a plurality of second spacer stubs, each second stub having inner and outer ends defining a second stub spacing axis, and the inner end of each second stub being secured to the second vessel wall so that the second stub extends outwardly therefrom with its axis generally perpendicular to adjacent portions of the second vessel wall and coaxially aligned with the spacing axis of one of the first stubs when the first and second vessels are at substantially the same temperature;

a third vessel defined by a third vessel wall and designed to surround the second vessel;

a plurality of second stub caps, each second stub cap having a recess therein and being secured to the third vessel wall with said recess axially aligned for reception of the outer end of one of the second stubs when the second and third vessel walls are at substantially the same temperature; and the stubs and stub caps being designed so that upon introduction of a low temperature liquified gas into the first vessel of the cryostat, thermal contaction of the vessels withdraws each spacer stub from the recess of its respective stub cap a distance sufficient to disengage said spacer stub and stub cap.

2. The cryostat vessel spacing system of claim 1 wherein each one of the first stub caps and one of the second spacer stubs are formed as a unitary spacer component.

3. The cryostat vessel spacing system of claim 1 wherein the spacer stubs and stub caps are made of materials having high mechanical strength and low thermal conductivity characteristics.

4. The cryostat vessel spacing system of claim 3 wherein the spacer stubs and stub caps are made of epoxy impregnated fiberglass having high mechanical and low thermal conductivity characteristics.

5. The cryostat vessel spacing system of claim 1 wherein a portion of each spacer stub comprises a generally cylindrical sleeve concentrically extending along the longitudinal axis of said spacer stub.

6. The cryostat vessel spacing system of claim 5 wherein the cylindrical sleeve has at least one drain hole therein to facilitate gas flow between adjacent vessel walls.

7. The cryostat vessel spacing system of claim 1 wherein the lateral cross-sectional area of the outer end of each spacer stub is reduced with respect to the lateral cross-sectional area of other portions of said spacer stub to reduce potential contact area between said spacer stub and its respective stub cap.

8. The cryostat vessel spacing system of claim 1, and further comprising:

a plurality of third spacer stubs, each third stub having inner and outer ends defining a third stub spacing axis, and the inner end of each third stub being secured to the third vessel wall so that the third stub extends outwardly therefrom with its axis generally perpendicular to adjacent portions of the third vessel wall and coaxially aligned with the spacing axis of one of the second stubs when the first and second vessels are at substantially the same temperature;

a fourth vessel defined by a fourth vessel wall and designed to surround the third vessel; and means for defining a plurality of recesses with respect to the fourth vessel wall, with each recess being axially aligned for reception of the outer end of one of the third stubs when the third and fourth vessel walls are at substantially the same temperature.

9. The cryostat vessel spacing system of claim 8 wherein each one of the second stub caps and one of the third spacer stubs are formed as a unitary spacer component.

10. The cryostat spacing system of claim 1 wherein the cryostat has an axis of thermal contraction about which portions of the nested vessels are positioned so that said first, second and third vessel walls extend parallel to one another generally perpendicularly with respect to said thermal contraction axis, and wherein the common axis of the coaxially aligned first and second spacer stubs extends parallel to said thermal contraction axis when the first and second vessels are at substantially the same temperature.

11. The cryostat spacing system of claim 10 wherein the recesses in the first and second stub caps are elongated in direction radially perpendicular to said thermal contraction axis.

12. In a cryostat of the type having at least two nested vessels, the improvement which comprises:

a plurality of rigid spacer stubs secured to a vessel wall of a first vessel and extending toward an adjacent vessel wall of a second vessel; and a plurality of stub caps secured to the adjacent vessel wall of the second nested vessel, each stub cap having a recess designed to retain one of the spacer stubs therein, with each spacer stub engaging its respective stub cap and being retained within the recess thereof when the walls of the nested vessels are at substantially the same temperature to uniformly and rigidly space apart the vessel walls of the nested vessels, but being withdrawn from the recess a distance sufficient to disengage said spacer stub and stub cap when the vessel walls thermally contract because of the introduction of low temperature liquified gas into an inner one of the nested vessels.

13. The invention of claim 12 wherein the first vessel constitutes said inner vessel and is nested within the second vessel.

* * * * *